US009625933B1

(12) United States Patent
Cui et al.

(10) Patent No.: US 9,625,933 B1
(45) Date of Patent: Apr. 18, 2017

(54) VOLTAGE REGULATION CIRCUIT

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Liang-Yi Cui, Shenzhen (CN); Jun-Jun Lu, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/921,127

(22) Filed: Oct. 23, 2015

(30) Foreign Application Priority Data

Sep. 25, 2015 (CN) ..... 2015 1 0623383

(51) Int. Cl.
*G05F 1/648* (2006.01)
*G05F 3/08* (2006.01)

(52) U.S. Cl.
CPC ..... *G05F 3/08* (2013.01)

(58) Field of Classification Search
CPC G05F 1/468; G05F 1/648; H02M 2001/0025; G11C 5/147
See application file for complete search history.

(56) References Cited

U.S. PATENT DOCUMENTS 4,468,607 A * 8/1984 Tanaka ..... H03H 7/24 323/354
4,489,270 A * 12/1984 Diller ..... H03H 7/24 323/354
5,389,872 A * 2/1995 Erhart ..... G09G 3/2011 323/354
5,717,323 A * 2/1998 Tailliet ..... H03H 11/54 257/E27.047
8,248,055 B2 * 8/2012 Pentakota ..... H03F 3/45475 323/297
9,287,772 B2 * 3/2016 Hussien ..... H02M 1/36
9,337,736 B2 * 5/2016 Chung ..... G05F 1/46

* cited by examiner

*Primary Examiner* — Gary L Laxton
(74) *Attorney, Agent, or Firm* — Steven M. Reiss

(57) ABSTRACT

A switchable voltage regulation circuit includes a power supply chip and a voltage regulation module. The voltage regulation module includes first and second resistors and first and second switch units. A first terminal of the first resistor is electrically coupled to a power supply and a first output pin of the power supply chip. A first terminal of the second resistor is electrically coupled to the second terminal of the first resistor. The first switch unit is electrically coupled between the first terminal of the first resistor and the second terminal of the first resistor. The second switch unit is electrically coupled between the first terminal of the second resistor and the voltage output. By manual switching, or by transistors under control of a baseboard management unit, the resistances can be switched in or switched out to regulate the voltage.

9 Claims, 2 Drawing Sheets

VOLTAGE REGULATION CIRCUIT

FIELD

The subject matter herein generally relates to voltage regulation.

BACKGROUND

When a server is tested, an output voltage of a motherboard will be adjusted to a maximal voltage, and the motherboard is installed in the server to test the server. After the server is tested at maximal voltage, the motherboard is removed from the server, and the output voltage of the motherboard will be adjusted to a minimum voltage through changing resistances. Then the motherboard is installed in the server to test the server again at minimal voltage.

BRIEF DESCRIPTION OF THE DRAWINGS

Implementations of the present technology will now be described, by way of example only, with reference to the attached figures.

DETAILED DESCRIPTION

Figure 1:
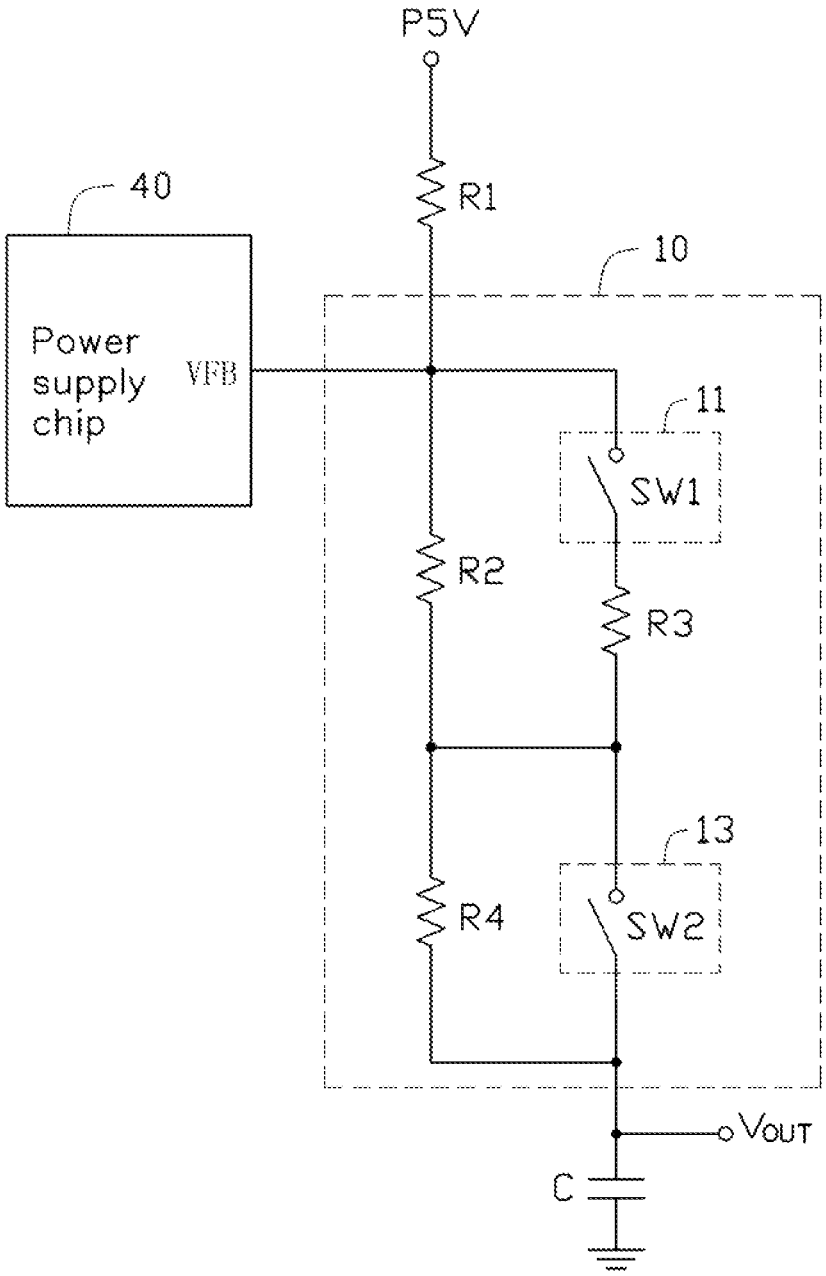
FIG. 1 is a circuit diagram of a first embodiment of a voltage regulation circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure relates to a voltage regulation circuit.

FIG. 1 illustrates an exemplary embodiment of a voltage regulation circuit. The voltage regulation circuit is configured to test an output voltage of a motherboard. The voltage regulation circuit comprises a power supply chip 40, a resistor R1, and a voltage regulation module 10.

The power supply chip 40 comprises an output pin VFB to provide a reference voltage Vf.

The voltage regulation module 10 comprises three resistors, R2-R4, and two switch units, 11 and 13. The voltage regulation module 10 is electrically coupled to ground, and is electrically coupled to a voltage output $V_{OUT}$. The switch unit 11 can comprise a single-pole single-throw switch SW1, and the switch unit 13 can comprise a single-pole single-throw switch SW2.

A first terminal of the resistor R1 is electrically coupled to a power supply P5V, and a second terminal of the resistor R1 is electrically coupled to the output pin VFB of the power supply chip 40, to a second terminal of the resistor R2, and to a first terminal of the switch SW1. A second terminal of the resistor R2 is electrically coupled to a first terminal of the resistor R4, and to a node between a second terminal of the resistor R3 and a first terminal of the switch SW2. A first terminal of the resistor R3 is electrically coupled to a second terminal of the switch SW1. The second terminals of the resistors R3 and R2 are electrically coupled to the first terminal of the resistor R4. A second terminal of the resistor R4 and a second terminal of the switch SW2 are electrically coupled to ground through a capacitor C, and are electrically coupled to the voltage output $V_{OUT}$.

When the switch SW1 is turned off and the switch SW2 is turned on, the resistor R4 is short circuited, and the resistor R1 and the resistor R2 work in series. The power supply P5V and the reference voltage Vf are output from the voltage output $V_{OUT}$ through the resistors R1 and R2, and the voltage output from the voltage output $V_{OUT}$ is a normal working voltage of the motherboard.

When the switch SW1 is turned on and the switch SW2 is turned off, the resistor R2 and the resistor R3 work in parallel, and the resistor R1, the resistor R2, and the resistor R4 are in series. The power supply P5V and the reference voltage Vf are output from the voltage output $V_{OUT}$ through the resistors R1-R4, and the voltage output from the voltage output $V_{OUT}$ is a maximal working voltage of the motherboard.

When the switches SW1 and SW2 are both turned off, the resistor R1, the resistor R2, and the resistor R4 work in series. The power supply P5V and the reference voltage Vf are output from the voltage output $V_{OUT}$ through the resistors R1, R2, and R4, and the voltage output from the voltage output $V_{OUT}$ is a minimum working voltage of the motherboard.

In at least one embodiment, a voltage value of the power supply P5V can be 5V, and a voltage value of the reference voltage Vf can be 0.6V. A resistance of the resistor R1 can be 14.2KΩ, a resistance of the resistor R2 can be 2 KΩ, a resistance of the resistor R3 can be 22K Ω, and a resistance of the resistor R4 can be 53.6 KΩ. The maximal working voltage value output from the voltage output $V_{OUT}$ can be 5.25V, and the minimum working voltage value from the voltage output $V_{OUT}$ can be 4.75V. In other embodiments, the resistance of the resistors R3 and R4 can be changed according to need, to adjust the maximal working voltage and the minimum working voltage output from the voltage output $V_{OUT}$.

Figure 2:
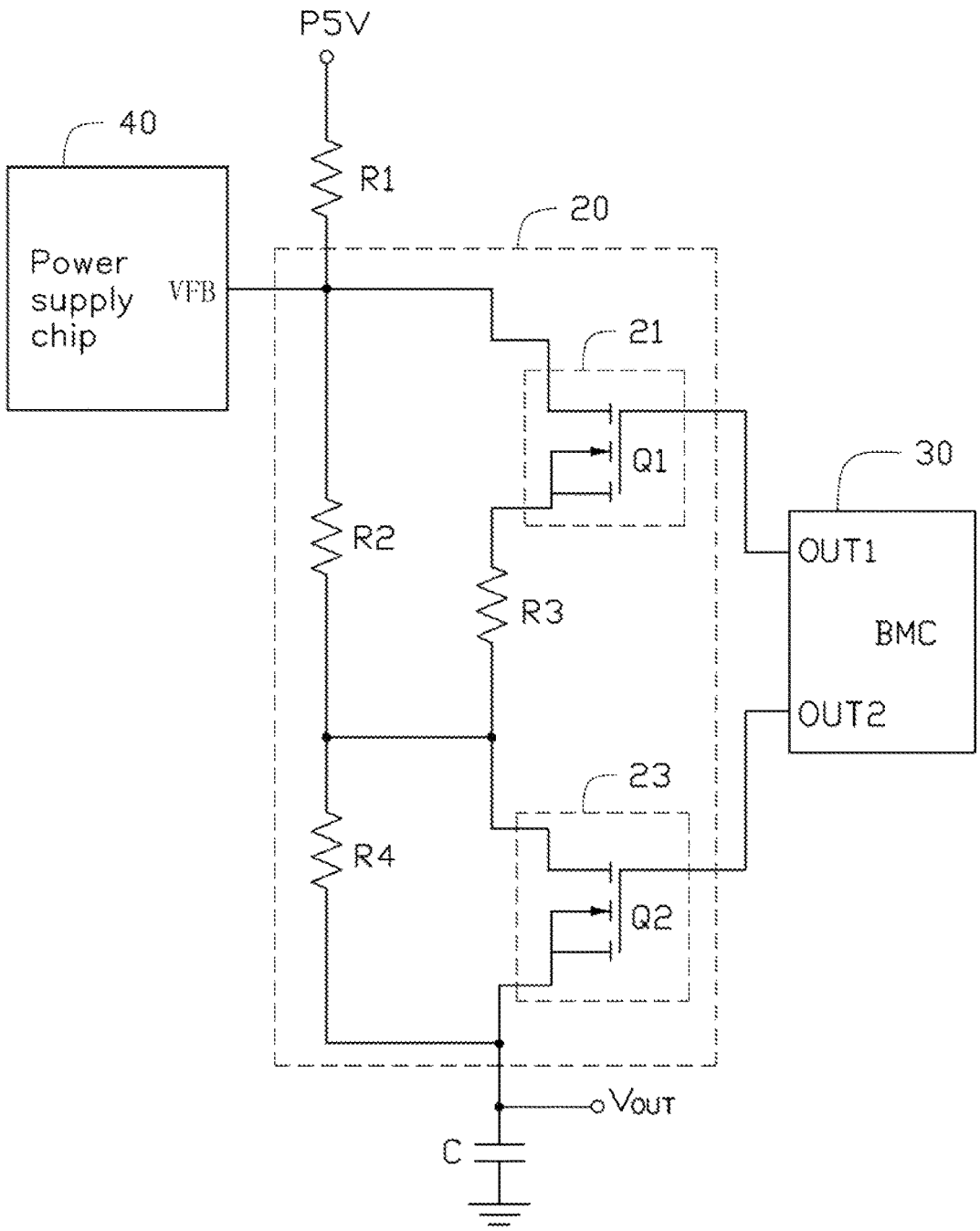
FIG. 2 is a circuit diagram of a second embodiment of a voltage regulation circuit.

FIG. 2 illustrates a second exemplary embodiment of a voltage regulation circuit. The voltage regulation circuit comprises a power supply chip 40, a resistor R1, a voltage regulation module 20, and a BMC (Baseboard Management Controller) 30.

The power supply chip 40 comprises an output pin VFB to provide a reference voltage Vf.

The voltage regulation module 20 comprises three resistors R2-R4 and two switch units 21 and 23. The voltage regulation module 20 is electrically coupled to ground, and is electrically coupled to a voltage output $V_{OUT}$. The switch unit 21 can comprise an electronic switch Q1, and the switch unit 23 can comprise an electronic switch Q2.

The BMC 30 comprises two output pins OUT1 and OUT2. The output pins OUT1 and OUT2 are respectively electrically coupled to a first terminal of the electronic switch Q1 and to a first terminal of the electronic switch Q2, to output a control signal to the electronic switch Q1 and to the electronic switch Q2 respectively.

A first terminal of the resistor R1 is electrically coupled to a power supply P5V, and a second terminal of the resistor R1 is electrically coupled to the output pin VFB of the power supply chip 40, to a second terminal of the resistor R2, and to a second terminal of the electronic switch Q1. A second terminal of the resistor R2 is electrically coupled to a first terminal of the resistor R4 and to a second terminal of the electronic switch Q2. A first terminal of the resistor R3 is electrically coupled to a third terminal of the electronic switch Q1. A second terminal of the resistor R3 is electrically coupled to the second terminal of the electronic switch Q2, to the second terminal of the resistor R2, and to the first terminal of the resistor R4. A second terminal of the resistor R4 and a third terminal of the electronic switch Q2 are electrically coupled to ground through a capacitor C, and are electrically coupled to the voltage output $V_{OUT}$.

In at least one embodiment, each of the electronic switches Q1 and Q2 can be n-channel metal-oxide semiconductor field-effect transistors (NMOSFET), and the first terminal, the second terminal, and the third terminal of the electronic switches Q1 and Q2 correspond to a gate, a drain, and a source of the NMOSFET.

The BMC 30 can start a first control program, a second control program, or a third control program according to a default program in the BMC 30. The BMC 30 controls the output pins OUT1 and OUT2 to output a high level signal or a low level signal to the electronic switches Q1 and Q2. When the BMC 30 starts the first control program, the BMC 30 controls the output pin OUT1 to output a low level signal to the first terminal of the electronic switch Q1, and the BMC 30 controls the output pin OUT2 to output a high level signal to the first terminal of the electronic switch Q2. The electronic switch Q1 is turned off and the electronic switch Q2 is turned on. The resistor R4 is short circuited, and the resistor R1 and the resistor R2 are in series. The power supply P5V and the reference voltage Vf are output from the voltage output $V_{OUT}$ through the resistors R1 and R2, and the voltage output from the voltage output $V_{OUT}$ is a normal working voltage of the motherboard.

When the BMC 30 starts the second control program, the BMC 30 controls the output pin OUT1 to output the high level signal to the first terminal of the electronic switch Q1, and the output pin OUT2 to output the low level signal to the first terminal of the electronic switch Q2. The electronic switch Q1 is turned on, and the electronic switch Q2 is turned off. The resistor R2 and the resistor R3 are in parallel, and the resistor R1, the resistor R2, and the resistor R4 are in series. The power supply P5V and the reference voltage Vf are output from the voltage output $V_{OUT}$ through the resistors R1-R4, and the voltage output from the voltage output $V_{OUT}$ is a maximal working voltage of the motherboard.

When the BMC 30 starts the third control program, the BMC 30 controls the output pin OUT1 to output the low level signal to the first terminal of the electronic switch Q1, and the output pin OUT2 to output the low level signal to the first terminal of the electronic switch Q2. The electronic switch Q1 is turned off, and the electronic switch Q2 is turned off. The resistor R1, the resistor R2, and the resistor R4 are in series. The power supply P5V and the reference voltage Vf are output from the voltage output $V_{OUT}$ through the resistors R1, R2, and R4, and the voltage output from the voltage output $V_{OUT}$ is a minimum working voltage of the motherboard.

In the illustrated embodiment, a voltage value of the power supply P5V can be 5V, and a voltage value of the reference voltage Vf can be 0.6V. A resistance of the resistor R1 can be 14.2 KΩ, a resistance of the resistor R2 can be 2 KΩ, a resistance of the resistor R3 can be 22 KΩ, and a resistance of the resistor R4 can be 53.6 KΩ. The maximal working voltage value output from the voltage output $V_{OUT}$ can be 5.25V, and the minimal working voltage value from the voltage output $V_{OUT}$ can be 4.75V. In other embodiments, the resistances of the resistors R3 and R4 can be changed according to need, to adjust the maximal working voltage and the minimal working voltages output from the voltage output $V_{OUT}$.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. A voltage regulation circuit comprising:

a power supply chip configured to provide a reference voltage and comprising a first output pin;

a voltage regulation module having a voltage output, which is electrically coupled to ground through a capacitor, the voltage regulation module comprises:

a first resistor having a first resistor first terminal and a first resistor second terminal, wherein the first resistor first terminal is electrically coupled to a power supply and the first output pin;

a second resistor having a second resistor first terminal and a second resistor second terminal, wherein the second resistor first terminal is electrically coupled to the first resistor second terminal, the second resistor second terminal is electrically coupled to ground through the capacitor;

a first switch unit electrically coupled between the first resistor first terminal and the first resistor second terminal; and a second switch unit electrically coupled between the second resistor first terminal and the voltage output;

wherein in event that the first switch unit is turned on and the second switch unit is turned off, the power supply and the power supply chip output a maximal working voltage from the voltage output through the first resistor and the second resistor;

wherein in event that the first switch unit is turned off and the second switch unit is turned off, the power supply and the power supply chip output a minimum working voltage from the voltage output through the first resistor and the second resistor.

2. The voltage regulation circuit of claim 1, wherein the voltage regulation module further comprises a third resistor, a first terminal of the third resistor is electrically coupled to the second terminal of the first switch unit; a second terminal of the third resistor is electrically coupled to the first terminal of the second switch unit, and the second terminal of the third resistor is electrically coupled to the first resistor second terminal and the second resistor first terminal.

3. The voltage regulation circuit of claim 1, wherein the first switch unit comprises a first switch, and the second switch unit comprises a second switch.

4. The voltage regulation circuit of claim 3, wherein the first switch and the second switch are single-pole single-throw switches.

5. The voltage regulation circuit of claim 1, wherein the first switch unit comprises a first electronic switch, the second switch unit comprises a second electronic switch.

6. The voltage regulation circuit of claim 5, wherein the voltage regulation circuit further comprises a baseboard management controller, the baseboard management controller comprises a second output pin and a third output pin, the second output pin is electrically coupled to a first terminal of the first electronic switch, the third output pin is electrically coupled to a first terminal of the second electronic switch.

7. The voltage regulation circuit of claim 6, wherein in event that the second output pin of the baseboard management controller outputs a first control signal to the first terminal of the first electronic switch, and the third output pin of the baseboard management controller outputs a second control signal to the first terminal of the second electronic switch, the first electronic switch is turned off and the second electronic switch is turned on; in event that the second output pin of the baseboard management controller outputs the second control signal to the first terminal of the first electronic switch, and the third output pin of the baseboard management controller outputs the first control signal to the first terminal of the second electronic switch, the first electronic switch is turned on and the second electronic switch is turned off; and in event that the second output pin of the baseboard management controller outputs the first control signal to the first terminal of the first electronic switch, and the third output pin of the baseboard management controller outputs the first control signal to the first terminal of the second electronic switch, the first electronic switch is turned off and the second electronic switch is turned off.

8. The voltage regulation circuit of claim 6, wherein each of the first and second electronic switches is an NPN-type bipolar junction transistor (BJT) or an n-channel metal-oxide semiconductor field-effect transistor (NMOSFET), the first terminal, a second terminal and a third terminal of the first and second electronic switches corresponding to a base, a collector and an emitter of the NPN-type bipolar junction transistor, respectively, or to a gate, a drain, and a source of the n-channel metal-oxide semiconductor field-effect transistor, respectively.

9. The voltage regulation circuit of claim 1, wherein the voltage regulation circuit further comprises a fourth resistor, a first terminal of the fourth resistor is electrically coupled to the power supply, and a second terminal of the fourth resistor is electrically coupled to the second resistor first terminal and the first terminal of the first switch unit.

* * * * *